US008679328B2

(12) United States Patent
Hebert

(10) Patent No.: US 8,679,328 B2
(45) Date of Patent: Mar. 25, 2014

(54) FLOOR DRAIN COVER

(71) Applicant: Frank Hebert, Bowie, MD (US)

(72) Inventor: Frank Hebert, Bowie, MD (US)

( * ) Notice: Subject to any disclaimer, the term of this patent is extended or adjusted under 35 U.S.C. 154(b) by 0 days.

(21) Appl. No.: 13/828,389

(22) Filed: Mar. 14, 2013

(65) Prior Publication Data

US 2013/0264256 A1 Oct. 10, 2013

Related U.S. Application Data

(60) Provisional application No. 61/622,503, filed on Apr. 10, 2012.

(51) Int. Cl.
*E03F 5/14* (2006.01)
*E02D 29/14* (2006.01)

(52) U.S. Cl.
USPC ..... 210/163; 210/164; 404/4

(58) Field of Classification Search
None
See application file for complete search history.

(56) References Cited

U.S. PATENT DOCUMENTS 521,266 A * 6/1894 Irwin ..... 43/63
592,194 A * 10/1897 Bumpass et al. ..... 217/56
853,598 A * 5/1907 Rile ..... 210/166
939,798 A * 11/1909 Bumpass ..... 217/36
1,483,157 A * 2/1924 Chabbert ..... 4/455
1,489,108 A * 4/1924 Barker ..... 119/51.01
1,791,512 A * 2/1931 Schurman ..... 210/163
2,160,003 A * 5/1939 Slayter et al. ..... 55/491
2,335,084 A * 11/1943 Rice ..... 209/408
2,455,383 A * 12/1948 Pickard ..... 209/323
2,497,902 A * 2/1950 Moyer ..... 209/381
2,754,928 A * 7/1956 Hambrecht et al. ..... 55/501
3,150,945 A * 9/1964 Baggeson ..... 55/493
3,183,527 A * 5/1965 Turner ..... 5/98.1
3,303,820 A * 2/1967 Boyles ..... 119/712
3,793,692 A * 2/1974 Tate et al. ..... 29/896.62
3,921,350 A * 11/1975 Van Schoyck ..... 52/180
4,035,297 A * 7/1977 Aldridge et al. ..... 210/163
4,105,423 A * 8/1978 Latakas et al. ..... 55/501
4,268,390 A * 5/1981 Cunningham ..... 210/232
4,329,939 A * 5/1982 Christie et al. ..... 119/528
4,418,432 A * 12/1983 Vidal ..... 4/286
4,419,232 A * 12/1983 Arntyr et al. ..... 210/164
4,483,640 A * 11/1984 Berger et al. ..... 405/15
4,594,157 A * 6/1986 McGowan ..... 210/163
4,658,449 A * 4/1987 Martin ..... 4/496
4,838,732 A * 6/1989 Clark et al. ..... 405/52
4,845,907 A * 7/1989 Meek ..... 52/177
4,953,501 A * 9/1990 Moreau ..... 119/528
4,988,234 A * 1/1991 Henkel et al. ..... 405/36
5,051,171 A * 9/1991 Hukki ..... 209/323

(Continued)

*Primary Examiner* — Robert James Popovics
(74) *Attorney, Agent, or Firm* — Global Intellectual Property Agency, LLC

(57) ABSTRACT

A floor drain cover is provided having a substantially rectangular frame defined by a first and second parallel outer frame member, perpendicular cross members connecting the outer frame members together, and an apertured screen positioned over the frame to prevent solid debris from passing therethrough and into a floor drain. The device is positioned over an existing floor drain to prevent debris from clogging the floor drain grate or drain interior. The apertured screen is elevated above the ground and positioned along the upper surfaces of the frame to collect falling debris, while debris is separated from free flowing water entering through the frame sides and ends by way of side frame member apertures and screened end portions. The cover can be periodically removed and cleaned, while the underlying drain is kept largely clean of debris that would otherwise require internal cleaning.

1 Claim, 4 Drawing Sheets

(56) References Cited

U.S. PATENT DOCUMENTS 5,141,633 A * 8/1992 Walczak et al. ..... 210/163
5,230,799 A * 7/1993 Willard et al. ..... 210/455
5,232,587 A * 8/1993 Hegemier et al. ..... 210/162
5,234,582 A * 8/1993 Savoie ..... 210/163
5,284,580 A * 2/1994 Shyh ..... 210/163
5,297,895 A * 3/1994 Johnson ..... 405/41
5,326,471 A * 7/1994 Pietzsch ..... 210/402
5,345,741 A * 9/1994 Slater et al. ..... 52/646
5,372,714 A * 12/1994 Logue, Jr. ..... 210/164
5,375,940 A * 12/1994 Kobayashi ..... 404/2
5,403,474 A * 4/1995 Emery ..... 210/163
5,405,539 A * 4/1995 Schneider ..... 210/747.3
5,419,282 A * 5/1995 Dennis ..... 119/166
5,480,254 A * 1/1996 Autry et al. ..... 404/2
5,522,344 A * 6/1996 Demurjian ..... 119/474
5,575,925 A * 11/1996 Logue, Jr. ..... 210/747.3
5,598,931 A * 2/1997 Hosogoshi et al. ..... 209/405
5,632,888 A * 5/1997 Chinn et al. ..... 210/163
5,664,686 A * 9/1997 Hosogoshi et al. ..... 209/405
5,689,928 A * 11/1997 Rasksen ..... 52/302.1
5,702,595 A * 12/1997 Mossburg, Jr. ..... 210/163
5,725,782 A * 3/1998 Chinn et al. ..... 210/767
5,733,444 A * 3/1998 Johnson ..... 210/163
5,733,445 A * 3/1998 Fanelli ..... 210/164
5,735,091 A * 4/1998 Hawkins et al. ..... 52/302.7
5,788,849 A * 8/1998 Hutter et al. ..... 210/163
5,813,365 A * 9/1998 Helmy ..... 119/528
5,843,306 A * 12/1998 Singleton ..... 210/163
5,851,393 A * 12/1998 Carr et al. ..... 210/489
5,855,774 A * 1/1999 Boelter ..... 210/155
5,948,250 A * 9/1999 Middleton ..... 210/232
5,954,952 A * 9/1999 Strawser, Sr. ..... 210/164
6,004,457 A * 12/1999 Singleton ..... 210/163
6,010,622 A * 1/2000 Chinn et al. ..... 210/164
6,059,964 A * 5/2000 Strawser, Sr. ..... 210/164
6,165,357 A * 12/2000 Cormier ..... 210/163
6,193,880 B1 * 2/2001 Bergeron ..... 210/162
6,202,857 B1 * 3/2001 Keller et al. ..... 209/404
6,261,444 B1 * 7/2001 Forse ..... 210/163
6,261,445 B1 * 7/2001 Singleton ..... 210/163
6,274,036 B1 * 8/2001 Ellis ..... 210/164
6,294,095 B1 * 9/2001 Lewis ..... 210/747.3
6,338,595 B1 * 1/2002 Schollen ..... 405/125
6,402,942 B2 * 6/2002 Cardwell et al. ..... 210/155
D460,810 S * 7/2002 Sommerhein ..... D23/261
6,416,674 B1 * 7/2002 Singleton et al. ..... 210/747.3
6,428,693 B2 * 8/2002 Singleton ..... 210/163
6,453,482 B1 * 9/2002 Mullings ..... 4/507
6,460,486 B1 * 10/2002 Powers et al. ..... 119/452
D466,198 S * 11/2002 Mullings ..... D23/261
6,530,722 B1 * 3/2003 Shaw et al. ..... 405/52
6,537,446 B1 * 3/2003 Sanguinetti ..... 210/163
6,551,023 B2 * 4/2003 Allard ..... 405/36
6,588,029 B2 * 7/2003 Mullings ..... 4/507
6,631,588 B1 * 10/2003 Distler ..... 52/12
6,706,172 B2 * 3/2004 Strawser, Sr. ..... 210/164
6,749,366 B1 * 6/2004 Chinn et al. ..... 405/41
6,808,623 B2 * 10/2004 Harris et al. ..... 210/164
6,843,616 B2 * 1/2005 Sychra ..... 405/32
6,872,029 B2 * 3/2005 Allard et al. ..... 405/36
6,889,631 B2 * 5/2005 McGregor ..... 119/528
6,908,549 B2 * 6/2005 Middleton et al. ..... 210/164
6,922,953 B1 * 8/2005 Lewis ..... 52/126.1
6,941,630 B2 * 9/2005 Wynn ..... 29/401.1
6,974,540 B1 * 12/2005 Fleischmann ..... 210/163
7,005,061 B1 * 2/2006 Downs et al. ..... 210/163
7,066,111 B2 * 6/2006 McGregor ..... 119/509
7,070,691 B2 * 7/2006 Lindemulder ..... 210/164
7,074,326 B2 * 7/2006 Singleton ..... 210/163
7,112,274 B1 * 9/2006 Sanguinetti ..... 210/163
7,156,987 B1 * 1/2007 Sanguinetti ..... 210/164
7,208,082 B2 * 4/2007 Hurst et al. ..... 210/164
7,270,747 B2 * 9/2007 Happel et al. ..... 210/162
7,300,573 B1 * 11/2007 Trangsrud ..... 210/163
7,404,690 B2 * 7/2008 Lukasik et al. ..... 404/36
7,407,574 B2 * 8/2008 Robinson ..... 210/163
7,455,474 B2 * 11/2008 Tievant et al. ..... 404/25
7,481,921 B2 * 1/2009 Kent ..... 210/164
7,488,414 B2 * 2/2009 Wimberger ..... 210/163
7,524,414 B1 * 4/2009 Barragan ..... 210/163
7,549,820 B1 * 6/2009 Happel ..... 404/4
7,662,280 B1 * 2/2010 Cooney ..... 210/164
7,682,104 B2 * 3/2010 Wassman et al. ..... 405/125
7,854,838 B2 * 12/2010 Martin ..... 210/163
7,879,233 B2 * 2/2011 Shaw et al. ..... 210/164
7,959,799 B2 * 6/2011 Happel et al. ..... 210/163
7,981,283 B2 * 7/2011 Happel et al. ..... 210/162
8,002,977 B2 * 8/2011 Shaw et al. ..... 210/164
8,017,006 B2 * 9/2011 Lopez ..... 210/163
8,034,237 B2 * 10/2011 Happel et al. ..... 210/170.03
8,043,498 B2 * 10/2011 Rueda ..... 210/164
8,051,568 B2 * 11/2011 Moody et al. ..... 29/896.62
8,132,385 B2 * 3/2012 Phillips et al. ..... 52/660
8,158,010 B2 * 4/2012 Pearse et al. ..... 210/747.1
8,216,453 B2 * 7/2012 Moody et al. ..... 210/163
8,535,523 B2 * 9/2013 Friezner et al. ..... 210/156
8,557,108 B2 * 10/2013 Rennels ..... 210/163
8,557,109 B1 * 10/2013 Sutherland ..... 210/163
2001/0023842 A1 * 9/2001 Singleton ..... 210/163
2001/0047955 A1 * 12/2001 Chinn et al. ..... 210/164
2002/0130070 A1 * 9/2002 Roesner ..... 210/163
2002/0130083 A1 * 9/2002 Middleton et al. ..... 210/660
2003/0053862 A1 * 3/2003 Shaw et al. ..... 405/40
2003/0217955 A1 * 11/2003 Strawser, Sr. ..... 210/163
2004/0047687 A1 * 3/2004 Sychra ..... 405/30
2004/0188357 A1 * 9/2004 Moore ..... 210/747
2004/0200767 A1 * 10/2004 Singleton ..... 210/163
2005/0000872 A1 * 1/2005 Middleton et al. ..... 210/163
2005/0230317 A1 * 10/2005 Belasco et al. ..... 210/691
2005/0247612 A1 * 11/2005 Glassheim ..... 210/163
2006/0091049 A1 * 5/2006 Hurst et al. ..... 210/163
2006/0201860 A1 * 9/2006 Happel et al. ..... 210/162
2007/0045162 A1 * 3/2007 Hurst et al. ..... 210/163
2007/0131597 A1 * 6/2007 Chen ..... 210/164
2007/0138074 A1 * 6/2007 Howard ..... 210/163
2007/0205144 A1 * 9/2007 Robinson ..... 210/163
2007/0295652 A1 * 12/2007 Kent ..... 210/164
2008/0006568 A1 * 1/2008 Moody et al. ..... 210/164
2008/0145150 A1 * 6/2008 Shaw et al. ..... 405/52
2008/0149544 A1 * 6/2008 Shaw et al. ..... 210/163
2008/0251470 A1 * 10/2008 Kent ..... 210/791
2008/0290042 A1 * 11/2008 Hanson et al. ..... 210/747
2008/0296211 A1 * 12/2008 Swan ..... 210/163
2010/0025312 A1 * 2/2010 Martin ..... 210/170.03
2010/0288684 A1 * 11/2010 Lopez ..... 210/163
2011/0049027 A1 * 3/2011 Rueda ..... 210/163
2011/0120923 A1 * 5/2011 Shaw et al. ..... 210/163
2011/0253641 A1 * 10/2011 Pearse et al. ..... 210/747.3
2012/0043266 A1 * 2/2012 Moody et al. ..... 210/163
2012/0074048 A1 * 3/2012 Glassheim ..... 210/165
2012/0222996 A1 * 9/2012 Rennels ..... 210/163
2013/0014704 A1 * 1/2013 Kuking ..... 119/479
2013/0264256 A1 * 10/2013 Hebert ..... 210/163

* cited by examiner

FLOOR DRAIN COVER

CROSS REFERENCE TO RELATED APPLICATION

This application claims the benefit of U.S. Provisional Application No. 61/622,503 filed on Apr. 10, 2012, entitled "Debris Filter for Storm Drain." The above identified patent application is herein incorporated by reference in its entirety to provide continuity of disclosure.

BACKGROUND OF THE INVENTION

1. Field of the Invention

The present invention relates to drain covers and filter screens that prevent discrete debris sources from entering into a drain and clogging the same, while allowing free flowing water to pass therethrough and into the drain. More specifically, the present invention pertains to a drain cover having a weighted, perforated structure that can simply be positioned over a drain to filter debris that may otherwise flow into or flow from the drain.

Outdoor drains provide a means to channel flowing water into a drainage system that may otherwise collect in an area or flood an open space. These drainage systems include sewer systems, French drains, and other conduits that allow water to exit a general area and flow to a basin or other location that will not cause property damage or flooding. These drains and drainage systems are commonly found in residential and commercial areas where flooding after a storm may be a factor, such as in low lying areas in a plot of land or around buildings.

One particular drain of interest is located at the base of a walk-out basement having a stairwell exit. The landing at the base of the steps is a common area where water can collect during a storm, posing a risk of flooding into the interior spaces of the dwelling. To prevent water from accumulating in this area, most of these landings include a graded surface and a water drain. The drain is a covered conduit that allows water to flow thereinto and into a distribution system, such as a sewer line, a French drain, or a similar piping system that takes the water away from the dwelling.

A common problem with storm drains and drains of this type is their exposure to outdoor elements and the propensity for solid debris to flow with the draining water as it drains thereinto. The solid debris creates a clogging hazard and a risk to the function of the drain. If dirt, leaves, and other debris sources are permitted to enter into the drain through its drain cover, the risk is that the debris will eventually or suddenly stop the flow of water, creating a blocked drain and therefore permit water to accumulate in the immediate vicinity. Further still, the debris can close the apertures in the drain cover itself and cease the flow of water into the drain conduit.

Allowing water to accumulate in a basement walk-out landing is a particularly common flood risk for a homeowner, as the purpose of the drain is easily defeated by solid debris flowing with the water. Therefore, a drain cover solution is required that can readily filter debris sources from the flowing water entering the drain, while at the same time allowing a user to remove the drain cover and clear debris from the cover that has been separated from the flowing water.

The present invention provides a deployable structure that is placed over an existing outdoor floor drain. The device comprises elongated members separated by cross members establishing an elevated frame. About the frame is secured a perforated screen that allows water to flow therethrough while blocking solid debris. The elongated members include apertures along their lengths to allow water to penetrate therethrough, thereby allowing water to flow into all sides of the frame while keeping out solid debris sources. The cover can be readily removed and cleaned as desired by the user, solving the issue of drain clogging that may otherwise occur in this outdoor drains.

2. Description of the Prior Art

Devices have been disclosed in the prior art that relate to floor drain covers and screens therefor. These include devices that have been patented and published in patent application publications. These devices generally relate to drain filters and device placed within the drain interior. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 7,156,987 to Sanguinetti discloses a storm drain filter device having a filter bag for removing debris from water flowing in the storm drain and a connector strap assembly for securing the filter bag to the storm drain grate. The filter device is placed in connection with the underside of a removed storm drain grate, wherein its connector straps secure over the top of the grate. The storm drain grate and filter are then placed into position over a storm drain to prevent debris from entering. The Sanguinetti device comprises a flexible screen cover that wraps around an existing storm drain grate. The present invention pertains to a drain cover screen that is placed over a floor drain and elevated thereover to prevent debris from entering into the drain.

Other devices relate to filter elements that are placed within the drain itself and below the drain grate. These include U.S. Pat. Nos. 6,537,446 and 7,112,274 to Sanguinetti, and U.S. Pat. No. 4,268,390 to Cunningham. Each of these devices describes a filter structure that is affixed within the drain itself and below the grate, wherein the filter prevents contaminates and debris from entering the drain. These devices, however, require a user to lift and remove the drain grate to change the filter over time as it accumulates the debris. The present invention is an external device that rests over an existing drain grate, whereby the cover device can be readily lifted and cleaned without entering the drain interior.

Overall, the present invention discloses a new and novel drain cover that is suited for floor drains and drains at the base of basement walk-out stairwells. The device is placed over an existing drain grate to block debris from entering therein, wherein its structure includes a first and second elongated member having connecting cross members establish a frame over which a screen or perforated surface can be overlaid, whereby the screen is elevated above the underlying drain grate while in use. It is submitted that the present invention is substantially divergent in design elements from the prior art, and consequently it is clear that there is a need in the art for an improvement to existing drain cover devices. In this regard the instant invention substantially fulfills these needs.

SUMMARY OF THE INVENTION

In view of the foregoing disadvantages inherent in the known types of drain covers, filters, and screens now present in the prior art, the present invention provides a new debris cover for a drain grate that can be utilized for providing convenience for the user when covering an existing drain grate and blocking large debris from entering the drain or clogging the existing drain grate.

It is therefore an object of the present invention to provide a new and improved drain cover device that has all of the advantages of the prior art and none of the disadvantages.

It is another object of the present invention to provide a drain cover device that includes an elevated screen structure supported by a rigid frame, wherein the frame is comprised of a first and second parallel member connected by cross members.

Another object of the present invention is to provide a drain cover device that can be deployed over an existing floor drain grate to prevent debris from clogging the drain grate or accumulating thereover.

Yet another object of the present invention is to provide a drain cover device that is particularly suited for use along the landing of walk-out basement stairs and over the floor drain therealong.

Another object of the present invention is to provide a drain cover device that is manually deployable and readily removable, wherein its structure comprises a weighted frame such that its debris-catching screen remains stationary during use without attachment means and the drain can be readily removed to clean the screen during periodic inspection and maintenance intervals.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
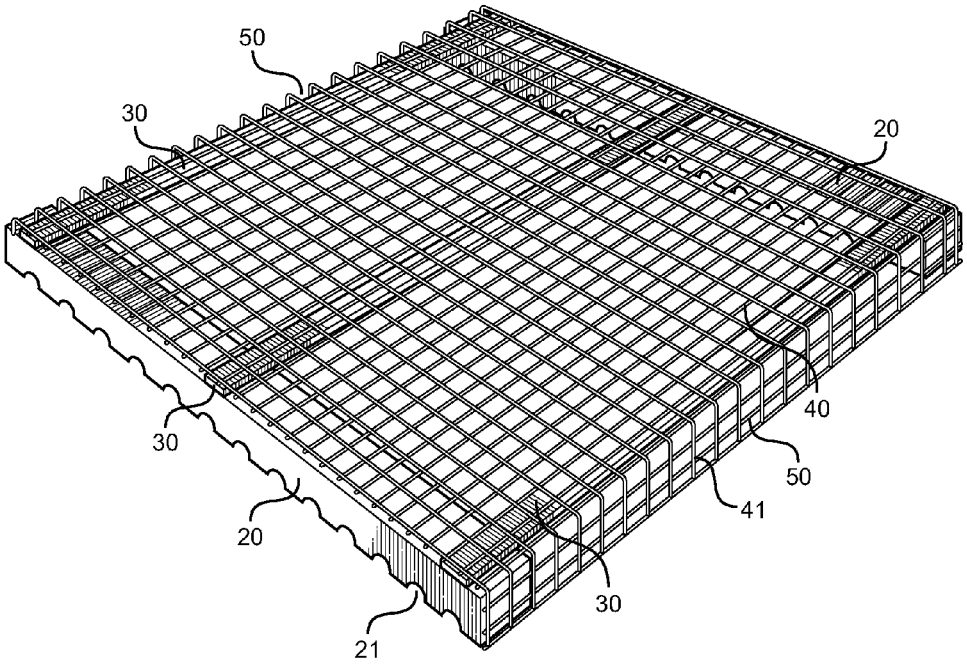
FIG. 1 shows an overhead perspective view of the present invention.

Reference is made herein to the attached drawings. Like reference numerals are used throughout the drawings to depict like or similar elements of the drain cover device. For the purposes of presenting a brief and clear description of the present invention, the preferred embodiment will be discussed as used for preventing debris from clogging or otherwise covering an existing floor drain grate. The figures are intended for representative purposes only and should not be considered to be limiting in any respect.

Referring now to FIG. 1, there is shown an overhead perspective view of the deployable floor drain cover device of the present invention. The device comprises a substantially rectangular or square frame defined by two opposing and parallel outer frame members 20 connected together by a plurality of perpendicular cross members 30 that span the gap between the frame members 20. The outer frame members 20 and the cross members 30 form the backbone of the assembly and provide a structure over which a perforated mesh or screen surface 40 is overlaid. The screen 40 is a lattice of crossed wire members that allow fluid to penetrate therethrough but block larger debris that cannot otherwise fit between the open sections of the screen.

Figure 2:
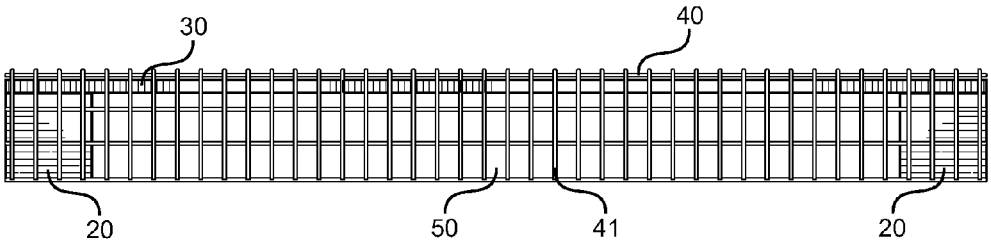
FIG. 2 shows a front view of the present invention.

The frame of the device provides a means to elevate the screen 40 above a ground surface, whereby the outer frame members 20 are positioned on the ground surface and adjacent to an existing floor drain grate. The screen 40 is supported by the outer frame members 20 and the cross members 30 in an elevated position above the drain and above the ground surface. The screen 30 extends along a largely horizontal plane across the upper surfaces of the frame and between the frame members/cross members. Along the ends 50 of the frame and as shown in FIG. 2, the screen 40 wraps downward 41 along a vertical plane to the lowermost extent of the outer frame members' 20 lower edge, whereby the screen wires 40 extend downwards 41 towards the ground surface to abut thereagainst. This prevents debris from flowing with any liquid and passing under the screen 30 and into the drain.

Figure 3:
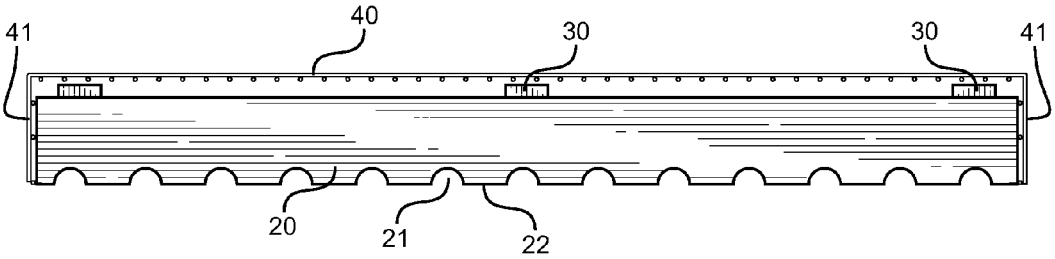
FIG. 3 show a side view of the present invention.

In a similar fashion and as shown in FIG. 3, the outer frame members 20 include a lower surface having arched apertures 21 therethrough along its interface with the ground surface. The apertures 21 allow fluid to travel therethrough such that water is not completely blocked by the outer frame members 20. Between the apertures 21 is a flat section 22 that abuts against a ground surface along the sides of an existing floor drain. Also shown in FIG. 3 is the arrangement of the outer frame members 20 with respect to the cross members 30, the elevated and horizontal portion of the screen 40, and the screened side portions extending downward 41.

Figure 4:
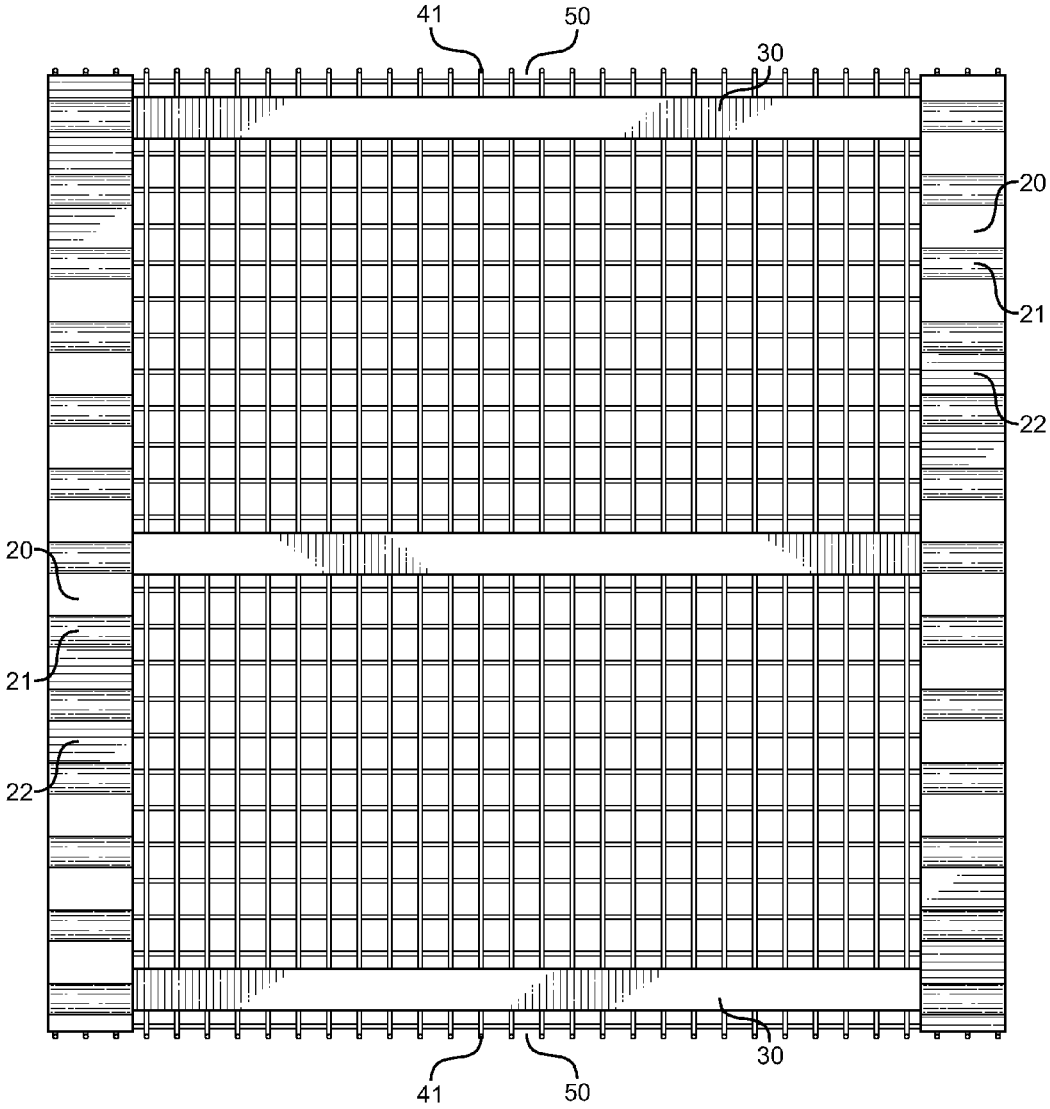
FIG. 4 shows an underside view of the present invention.

Referring now to FIG. 4, there is shown an underside view of the floor drain cover of the present invention. As shown, the underside surface of the outer frame members 20 includes the semi-circular apertures 21 and flat segments 22 that allow water to flow therethrough while blocking a majority of the larger debris. This arrangement is similar to the ends 50 of the device, whereby water is free to flow through the device and into a drain therewithin by way of the downward screen 41, which blocks debris while allowing water to flow. The cross members 30 of the frame are positioned across the device and connect to the upper surfaces of the outer frame members 20. In this way, the cross members are elevated above the ground and do not pose a clogging risk.

Figure 5:
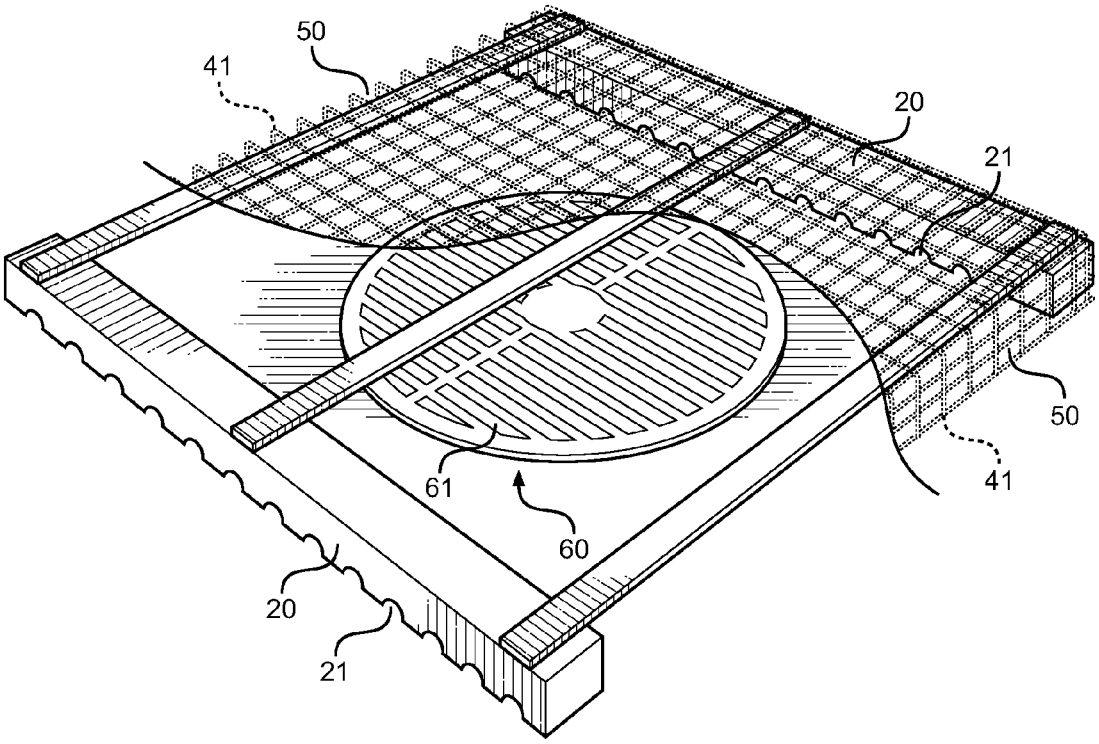
FIG. 5 shows an overhead perspective view of the present invention in a working position over an existing drain.

Referring finally to FIG. 5, there is shown an overhead view of the present invention in a working state over an existing floor drain 60, which by itself allows water to drain through its grate 61 and thereinto for water collection and removal from an area. These floor drains are common in outdoor spaces and in basement walk-out stair landings, which otherwise collect considerable volumes of water during heavy rainfall. FIG. 5 shows the positioning of the present drain cover over the drain 60, whereby the upper screen is cut-away for visualization purposes.

When deployed, the frame outer members 20 are positioned on opposing sides of the drain 60 with the interior of the frame covering the extents of the drain grate 61. The elevated cross members support the screen above the grate 61 and filter large debris from above, while the sides 50 of the device are protected by downward projections 41 of the screen therealong. Along the ends of the device, the outer frame members 20 allow water to flow through apertures 21 along its length while blocking debris from pass therethrough.

The disclosed frame includes a substantially rectangular section having a pair of opposing ends and a pair of opposing sides. The frame sides are defined by the elongated frame side members, which support the elevated cross members and the screen above the ground surface and above a drain. The frame side members include an underside surface that abuts against the ground, while the cross members are offset from said outer frame member underside surface, either connected over the upper portion of the side frame members or projecting therefrom. The planar debris screen is positioned over frame outer frame members and cross members in a largely horizontal plane, while along the ends of the frame the screen extends downward in a largely vertical plane, terminating along a plane defined by the outer frame member underside surfaces. The screen separates debris from flowing water while allowing the flowing water to pass therethrough and into the drain. Similarly, the apertured or slotted side frame members allow water to flow therethrough along the sides of the frame.

For basements with outdoor stairwells, there is generally a small floor drain at the base of the stairwell, which drains water that may otherwise accumulate against an adjacent doorway leading into an interior space. During heavy rainfalls, debris flowing with the water accumulation can make its way to the base of this stairwell, clogging the small drain with leaves, dirt, and other debris sources. This causes water to rise over the adjacent doorsill and flood the interior space.

The present drain cover device is constructed of parallel lengths of heavy-duty plastic or metallic sections that define the outer frame members, where the sections may be solid or tubular. Cross members secure the two outer frame members together in a parallel configuration, whereby the upper surface of the cross members and the outer frame members acts as a support for a screen positioned thereover and extending downward towards the ground.

Apertures or grooves along the underside of the outer frame members provide a gap between the outer frame members and ground surface (exterior surface or concrete drain pan surface). The wire screen of the frame, together with the outer frame member apertures, separate debris from flowing water that is flowing into the drain therebelow. The screen can be a metallic wire screen material having a plurality of opening sections therethrough, or alternatively the screen can be a vinyl mesh material. Any type of screen, wire mesh, or filter member is contemplated for use with the disclosed frame.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A storm drain, the improvement being a removable drain cover comprising:

a substantially rectangular frame including:

a pair of opposing, elongated, outer frame members positioned parallel to one another, said outer frame members each having a top surface and an underside surface, each said underside surface having a plurality of grooves therein, placing an interior of said rectangular frame in fluid communication with an exterior thereof;

a plurality of cross members spanning said rectangular frame and connected to said top surface of said outer frame members; and a planar debris screen positioned over said frame outer frame members and said cross members in a largely horizontal plane, said debris screen extending over said frame and ends in a largely vertical plane, terminating about all sides of said rectangular frame along a plane defined by said outer frame member underside surfaces, wherein said planar debris screen allows water to flow therethrough while blocking solid debris, and said grooves allow water to flow through the frame members while keeping out solid debris.

* * * * *